US010815606B2

(12) United States Patent
Bensel et al.

(10) Patent No.: US 10,815,606 B2
(45) Date of Patent: Oct. 27, 2020

(54) WASHING MACHINE APPLIANCE WITH SMART DISPENSE

(71) Applicant: Haier US Appliance Solutions, Inc., Wilmington, DE (US)

(72) Inventors: Peter Hans Bensel, Louisville, KY (US); Troy Marshall Wright, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 174 days.

(21) Appl. No.: 15/908,885

(22) Filed: Mar. 1, 2018

(65) Prior Publication Data

US 2019/0271107 A1 Sep. 5, 2019

(51) Int. Cl.
*D06F 39/02* (2006.01)
*D06F 34/18* (2020.01)

(52) U.S. Cl.
CPC ..... *D06F 39/024* (2013.01); *D06F 34/18* (2020.02); *D06F 39/022* (2013.01)

(58) Field of Classification Search
CPC ..... D06F 39/022
See application file for complete search history.

(56) References Cited

U.S. PATENT DOCUMENTS

| | | | | |
|---|---|---|---|---|
| 7,725,970 | B2 | 6/2010 | Tuttle et al. | |
| 8,206,512 | B2 | 6/2012 | Guadinger et al. | |
| 2003/0116177 | A1* | 6/2003 | Appel | A47L 15/4472 134/18 |
| 2010/0162774 | A1* | 7/2010 | Reason | D06F 23/065 68/139 |
| 2012/0060302 | A1* | 3/2012 | Hanau | D06F 58/203 8/137 |
| 2017/0342634 | A1* | 11/2017 | Kuniavsky | D06F 39/004 |
| 2019/0287153 | A1* | 9/2019 | Shu | G06Q 30/02 |

FOREIGN PATENT DOCUMENTS

| | | | |
|---|---|---|---|
| EP | 2860295 | B1 | 8/2017 |
| WO | WO2017129067 | A1 | 8/2017 |

* cited by examiner

*Primary Examiner* — Spencer E Bell
(74) *Attorney, Agent, or Firm* — Dority & Manning, P.A.

(57) ABSTRACT

A washing machine appliance with smart dispensing capability is provided. The washing machine appliance has features that dispense a predetermined volume of wash additive (e.g., a detergent, fabric softener, and/or bleach) based at least in part on the viscosity of the wash additive. Methods for operating the washing machine appliance are also provided.

16 Claims, 7 Drawing Sheets

WASHING MACHINE APPLIANCE WITH SMART DISPENSE

FIELD OF THE INVENTION

The present disclosure relates generally to washing machine appliances and more particularly to washing machine appliances with smart wash additive dispense capability.

BACKGROUND OF THE INVENTION

Washing machine appliances can use a variety of wash additives (e.g., a detergent, fabric softener, and/or bleach) in addition to water to assist with washing and rinsing a load of articles. For example, detergents and/or stain removers may be added during wash and prewash cycles of washing machine appliances. As another example, fabric softeners may be added during rinse cycles of washing machine appliances. Wash additives are preferably introduced at an appropriate time during the operation of washing machine appliance and in a proper volume. By way of example, adding insufficient volumes of either the detergent or the fabric softener to the laundry load can negatively affect washing machine appliance operations by diminishing efficacy of a cleaning operation. Similarly, adding excessive volumes of either the detergent or the fabric softener can also negatively affect washing machine appliance operations by diminishing efficacy of a cleaning operation.

Dispensing the proper volume of wash additives has been challenging at least in part due to the viscosity variation in wash additives on the market. For instance, kinematic viscosities of wash additives can range from about one hundred fifty to over one thousand centistokes (150-1,000 cSt). Conventionally, detergent has been dispensed based on an "activation time" or "on time" of a component of the washing machine appliance, such as e.g., a dosing pump or a water inlet valve. Despite the wide ranging viscosities of wash additives used in washing machine appliance, the "activation time" is generally not modified or altered based on the viscosity of the wash additive loaded into the washing machine appliance. Accordingly, the proper volume of wash additive for achieving optimal wash performance of articles is rarely achieved. Further, in instances where the viscosity of the wash additive is relatively low, too much wash additive may be dispensed, which may lead to inefficient use of the wash additive and poor wash performance. In addition, in instances where the viscosity of the wash additive is relatively high, too little wash additive may be dispensed, which may lead to ineffective use of the wash additive and poor wash performance.

Accordingly, washing machine appliances and methods for operating such washing machine appliances that address one or more of the challenges noted above would be useful.

BRIEF DESCRIPTION OF THE INVENTION

The present disclosure provides a washing machine appliance with smart dispensing capability, and more particularly, a washing machine appliance is provided that has features that dispense a predetermined volume of wash additive (e.g., a detergent, fabric softener, bleach, etc.) based at least in part on the viscosity of the wash additive. In this way, when the volume of wash additive is mixed with water to form a wash fluid, the wash fluid is optimal for wash performance. Moreover, efficient use of wash additives are achieved with the smart dispense capability of the washing machine appliance. Methods for operating such washing machine appliances with smart dispensing capability are also provided. Additional aspects and advantages of the invention will be set forth in part in the following description, or may be apparent from the description, or may be learned through practice of the invention.

In accordance with one exemplary embodiment, a washing machine appliance is provided. The washing machine appliance includes a cabinet and a tub positioned within the cabinet. The washing machine appliance also includes a wash basket rotatably mounted within the tub, the wash basket defining a wash chamber for receiving articles for washing. Further, the washing machine appliance includes a dispensing system comprising one or more components for delivering a wash fluid to the wash chamber, the dispensing system comprising an additive dispenser for containing a wash additive configured to be mixed with the wash fluid. In addition, the washing machine appliance includes a controller communicatively coupled with the one or more components of the dispensing system, the controller configured to: receive an input indicative of a viscosity of the wash additive contained within the additive dispenser; determine an activation time for the one or more components of the dispensing system based at least in part on the input; and activate the one or more components for the activation time such that a predetermined volume of the wash additive is dispensed into the wash chamber.

In accordance with another exemplary embodiment, a method for operating a washing machine appliance is provided. The method includes receiving an input that is indicative of a viscosity of a wash additive to be dispensed into a wash chamber defined by the washing machine appliance. The method also includes determining an activation time of one or more components of a dispensing system of the washing machine appliance based at least in part on the input such that a predetermined volume of a wash additive is dispensed into the wash chamber. The method further includes activating the one or more components based at least in part on the activation time.

In some implementations, the method includes determining the viscosity of the wash additive.

In yet further implementations, determining the viscosity of the wash additive includes jolting a container in which the wash additive is stowed together with a user device; recording an acceleration profile of the wash additive within the container; determining a slosh time of the wash additive based at least in part on the acceleration profile of the wash additive; and determining the viscosity of the wash additive based at least in part on the slosh time of the wash additive.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
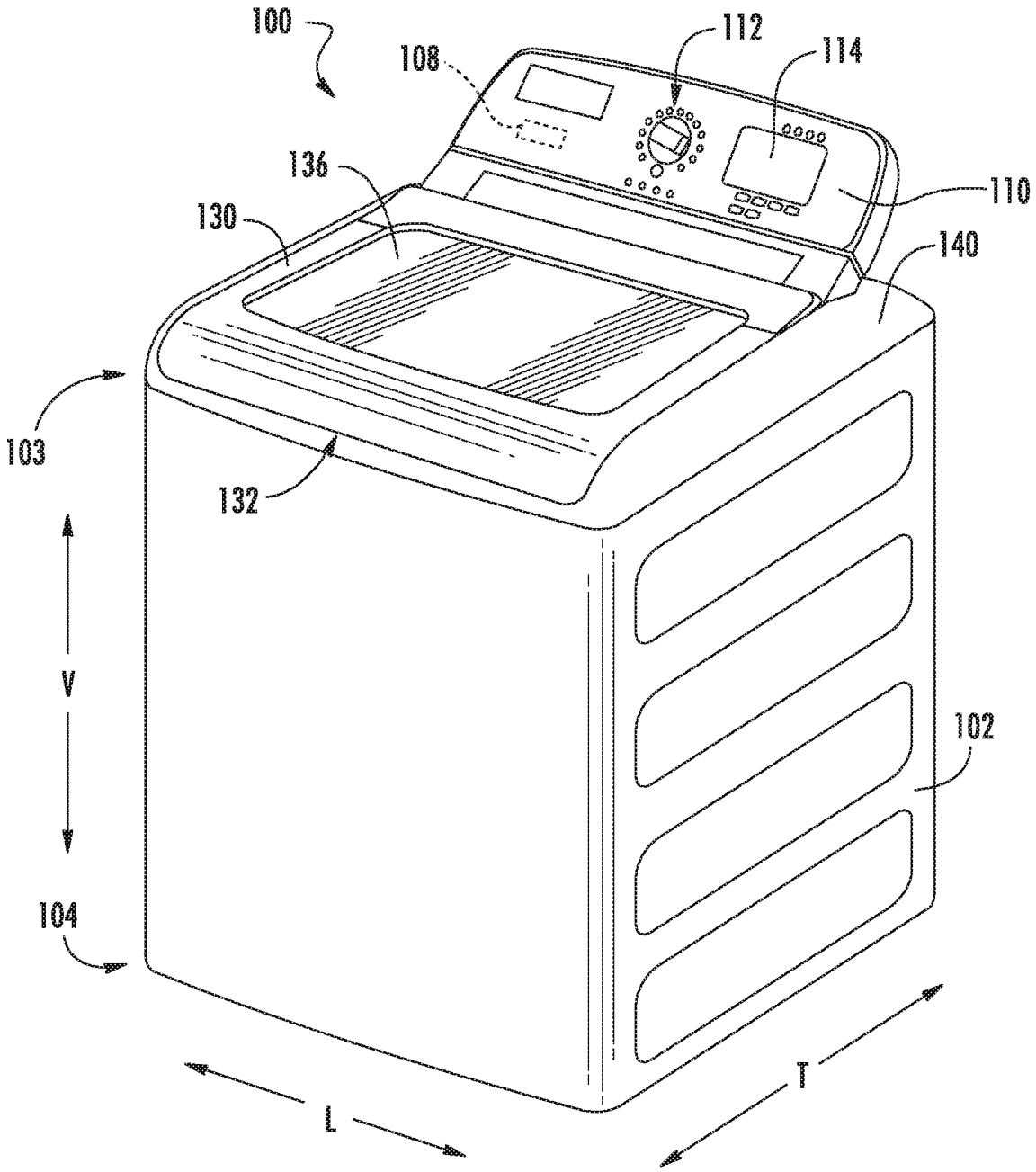
FIG. 1 provides a perspective view of a washing machine appliance according to embodiments of the present disclosure with a door of the washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents. As used herein, terms of approximation, such as "about" and "approximately," refer to being within a ten percent (10%) margin of error.

Figure 2:
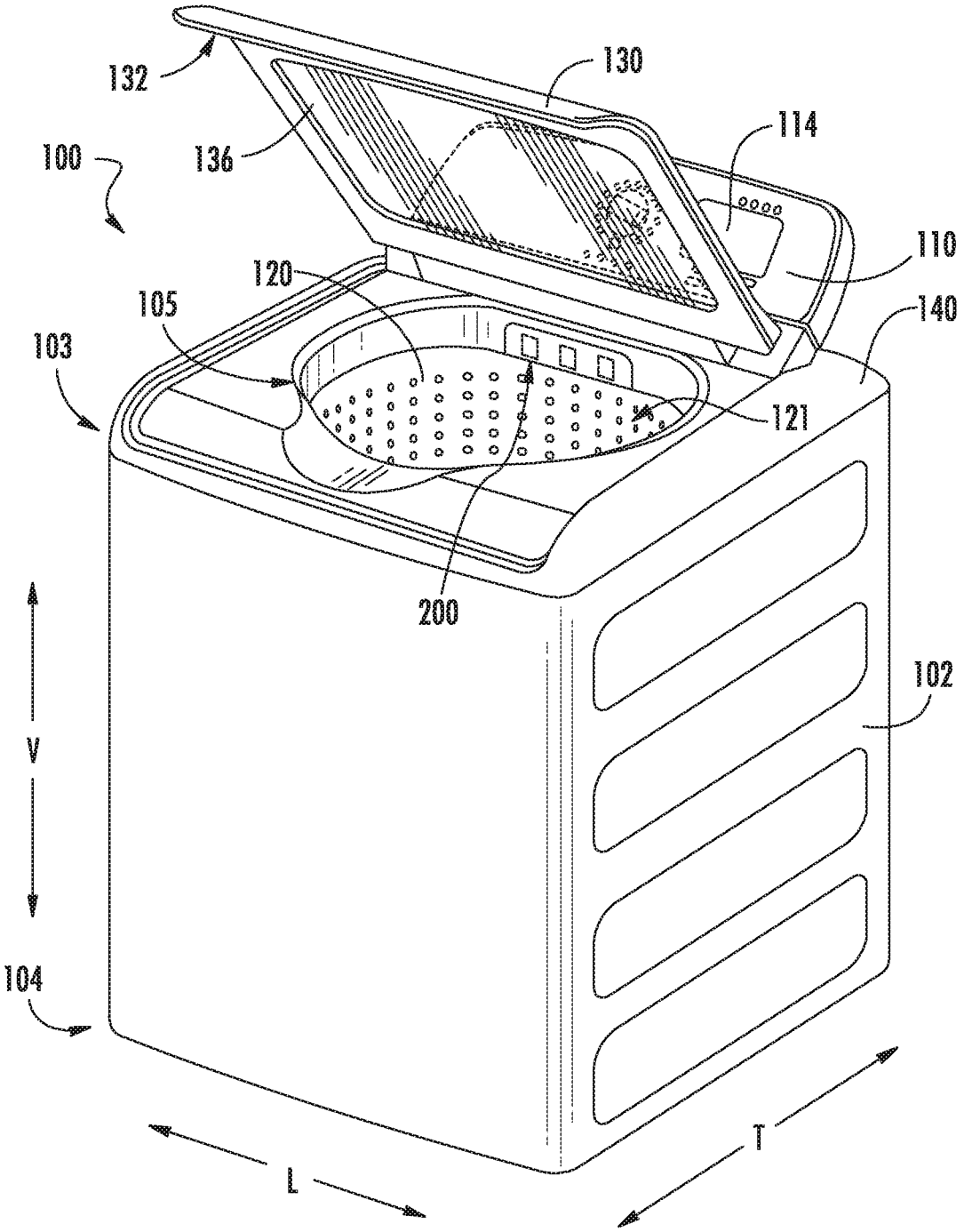
FIG. 2 provides a perspective view of the washing machine appliance of FIG. 1 with the door shown in an open position.

FIGS. 1 and 2 provide an example embodiment of a vertical axis washing machine appliance 100. In FIG. 1, a lid or door 130 is shown in a closed position. In FIG. 2, door 130 is shown in an open position. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, using the teachings disclosed herein it is understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that extends between a top portion 103 and a bottom portion 104 along the vertical direction V. A wash basket 120 (FIG. 2) is rotatably mounted within cabinet 102. A motor (not shown) is in mechanical communication with wash basket 120 to selectively rotate wash basket 120 (e.g., during an agitation or a rinse cycle of washing machine appliance 100). Wash basket 120 is received within a wash tub 121 (FIG. 2) and is configured for receipt of articles for washing. The wash tub 121 defines a wash chamber that holds wash and rinse fluids for agitation in wash basket 120 within wash tub 121. An agitator or impeller (not shown) extends into wash basket 120 and is also in mechanical communication with the motor. The impeller assists agitation of articles disposed within wash basket 120 during operation of washing machine appliance 100.

Cabinet 102 of washing machine appliance 100 has a top panel 140. Top panel 140 defines an opening 105 (FIG. 2) that permits user access to wash basket 120 of wash tub 121. Door 130, which is rotatably mounted to top panel 140, permits selective access to opening 105; in particular, door 130 selectively rotates between the closed position shown in FIG. 1 and the open position shown in FIG. 2. In the closed position, door 130 inhibits access to wash basket 120. Conversely, in the open position, a user can access wash basket 120. An optional window 136 in door 130 may permit viewing of wash basket 120 when door 130 is in the closed position, e.g., during operation of washing machine appliance 100. Door 130 also includes a handle 132 that, e.g., a user may pull and/or lift when opening and closing door 130. Further, although door 130 is illustrated as mounted to top panel 140, alternatively, door 130 may be mounted to cabinet 102 or any other suitable support.

A control panel 110 with at least one input selector 112 (FIG. 1) extends from top panel 140. Control panel 110 and input selector 112 collectively form a user interface input for operator selection of machine cycles and features. A display 114 of control panel 110 indicates selected features, operation mode, a countdown timer, and/or other items of interest to appliance users regarding operation.

Operation of washing machine appliance 100 is controlled by a controller or processing device 108 (FIG. 1) that is connected (e.g., electrically coupled) to control panel 110 for user manipulation to select washing machine cycles and features. In response to user manipulation of control panel 110, controller 108 operates the various components of washing machine appliance 100 to execute selected machine cycles and features.

Controller 108 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

During operation of washing machine appliance 100, laundry items may be loaded into wash basket 120 through opening 105, and washing operation may be initiated through operator manipulation of input selectors 112. Wash additives may be added to washing machine appliance 100 to assist in the cleaning process. In this regard, as will be described in detail below, a smart dispensing system 200 is configured to provide one or more wash additives, such as powdered detergent, concentrated wash fluid, pretreating additive, bleach, etc.

Water may be added to smart dispensing system 200 to mix with wash additives to create a wash fluid that may be dispensed into wash tub 121 and wash basket 120. One or more valves can be controlled by washing machine appliance 100, e.g., at controller 108, to provide for filling wash basket 120 to the appropriate level for the amount of articles being washed and/or rinsed. By way of example for a wash mode, once wash basket 120 is properly filled with fluid, the contents of wash basket 120 can be agitated (e.g., with an impeller as discussed previously) for washing of laundry items in wash basket 120.

After the agitation phase of the wash cycle is completed, wash basket 120 can be drained. Laundry articles can then be rinsed by again adding fluid to wash basket 120 depending on the specifics of the cleaning cycle selected by a user. The impeller may again provide agitation within wash basket 120. One or more spin cycles also may be used. In particular, a spin cycle may be applied after the wash cycle and/or after the rinse cycle to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash basket 120 through opening 105.

Figure 3:
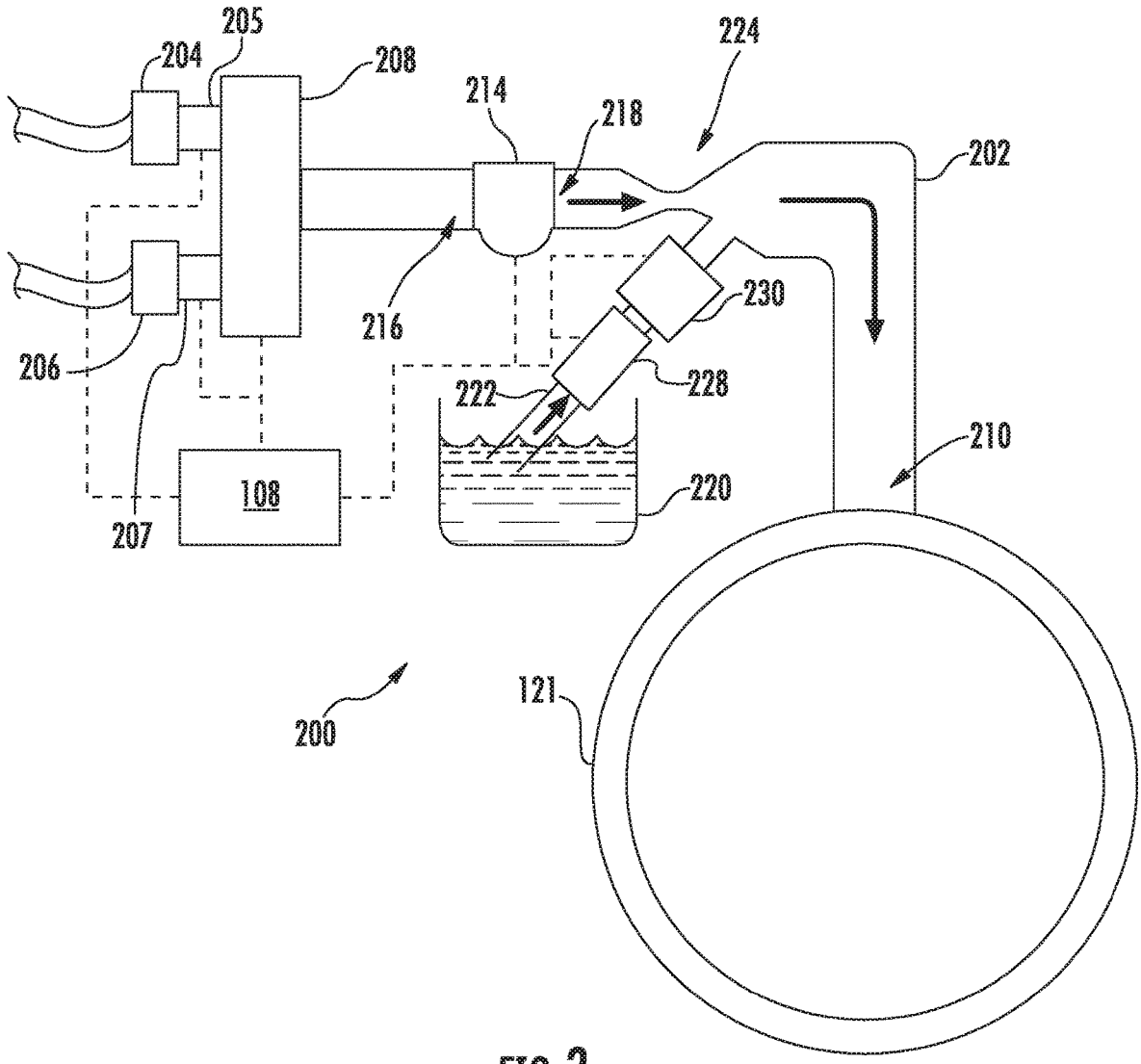
FIG. 3 provides a schematic view of an exemplary dispensing assembly for the washing machine appliance of FIGS. 1 and 2.

FIG. 3 provides a schematic view of smart dispensing system 200 of washing machine appliance 100 of FIGS. 1 and 2. Although the discussion below refers to smart dispensing system 200 for washing machine appliance 100 of FIGS. 1 and 2, one skilled in the art will appreciate that the features and configurations described may be used for other fluid dispensers in other washing machine appliances as well. For example, smart dispensing system 200 may be positioned elsewhere within cabinet 102, may have a different components or configurations, and may dispense water, detergent, or other additives. Other variations and modifications of the example embodiments described below are possible, and such variations are contemplated as within the scope of the present subject matter.

Smart dispensing system 200 may be mounted within cabinet 102 using a plurality of mounting features or mechanical fasteners (FIG. 2). Additionally or alternatively, adhesive(s), snap-fit mechanisms, interference-fit mechanisms, or any suitable combination thereof may secure smart dispensing system 200 to cabinet 102. One skilled in the art will appreciate that smart dispensing system 200 may be mounted in other locations and use other mounting means according to alternative embodiments.

As shown in FIG. 3, water and/or wash fluid is provided to wash tub 121 through a fluid supply conduit 202. For this embodiment, fluid supply conduit 202 may receive hot and cold water from a water inlet valve 208. More particularly, fluid supply conduit 202 may receive hot and cold water from a hot water inlet 204 and a cold water inlet 206, respectively, of water inlet valve 208. Hot water inlet 204 is in fluid communication with a hot water supply, such as a domestic or commercial hot water tank. Cold water inlet 206 is in fluid communication with a cold water supply, such as a well or municipal water-supply network.

In order to dispense wash fluid at the desired temperature, hot and cold water may be selectively dispensed in ratios that produce the desired water temperature. For example, the flow of hot water through hot water inlet 204 may be selectively adjusted using a hot water valve 205 of water inlet valve 208. Moreover, the flow of cold water through cold water inlet 206 may be selectively adjusted using a cold water valve 207 of water inlet valve 208. Controller 108 is communicatively coupled (e.g., via a wireless or wired connection) with water inlet valve 208, and more particularly, with one or more of valves 205, 207 such that the one or more valves 205, 207 can be controlled to modulate in accordance with the settings manually or automatically set by the user and/or washing machine appliance 100. According to one or more wash conditions, the flow of water through one or both of hot and cold water valves 205, 207 may be increased or decreased. For instance, one or both of hot water valve 205 or cold water valve 207 may be selectively controlled to provide water at a predetermined temperature based on at least one of the selected wash cycle, the soil level of the articles to be washed, and the article type. In accordance with exemplary aspects of the present disclosure, the hot and cold water valves 205, 207 may be selectively controlled to provide water at the predetermined temperature based at least in part on the viscosity of one or more wash additives loaded into washing machine appliance 100. During operation, water inlet valve 208 may selectively permit water (e.g., a mixture of hot water and cold water) into fluid supply conduit 202.

As illustrated, fluid supply conduit 202 may extend to (e.g., terminate at) wash tub 121. According to the illustrated embodiment, fluid supply conduit 202 is fluidly connected to wash tub 121 through a dispensing nozzle 210. Fluid supply conduit 202 may connect to wash tub 121 in any manner suitable for dispensing water and/or wash fluid into wash tub 121. For example, dispensing nozzle 210 may have a tapered or narrowed diameter from fluid supply conduit 202. Alternatively, fluid supply conduit 202 may simply terminate at wash tub 121 with no change in its diameter, or fluid supply conduit 202 may have a Venturi-shaped end.

The smart dispensing system 200 includes an inductive regulator 214 positioned downstream of and in fluid communication with the water inlet valve 208. The inductive regulator 214 defines an inlet 216 and an outlet 218 and is generally positioned along the fluid supply conduit 202. Moreover, inductive regulator 214 is positioned upstream of wash tub 121. Inductive regulator 214 is positioned between water inlet valve 208 and dispensing nozzle 210 and provides fluid communication between water inlet valve 208 and dispensing nozzle 210. As will be described in greater detail below, inductive regulator 214 propels or restricts wash fluid through fluid supply conduit 202, e.g., from inlets 204, 206 to wash tub 121.

For this embodiment, controller 108 is communicatively coupled with inductive regulator 214. According to one or more wash conditions, inductive regulator 214 may be activated to regulate fluid (e.g., water or wash fluid) therethrough. For instance, inductive regulator 214 may be selectively controlled or activated to generate a pump pressure or volumetric flow rate based on at least one of the selected wash cycle, the soil level of the articles to be washed, and the article type. In accordance with exemplary aspects of the present disclosure, inductive regulator 214 may be controlled or activated to generate a pump pressure or volumetric flow rate based at least in part on the viscosity of one or more wash additives loaded into washing machine appliance 100. The pump pressure or volumetric flow rate generated downstream of inductive regulator 214 may be greater than or less than a pump pressure or volumetric flow rate upstream of inductive regulator 214 (e.g., at water supply).

As further depicted in FIG. 3, the smart dispensing system 200 includes an additive dispenser 220, e.g., a reservoir for storing wash additive. In this regard, additive dispenser 220 may be configured to receive one or more wash additives. More particularly, additive dispenser 220 includes a reservoir that is intended to store sufficient wash additives for one or more wash cycles. Wash additive may be either a liquid or particulate material (e.g., a liquid, a particulate, or a combination of a liquid and a particulate). Example wash additives include detergent, fabric softener, a mixture of detergent and fabric softener, bleach, and/or other suitable wash additives.

Additive dispenser 220 is fluidly connected to (e.g., in fluid communication with) fluid supply conduit 202 through an additive supply conduit 222. As water is supplied through fluid supply conduit 202 into wash tub 121, additive dispenser 220 may release a predetermined volume of additive through additive supply conduit 222. In this manner, the flowing water may entrain, mix, and dissolve the wash additive to form a wash fluid prior to dispensing into wash tub 121 through dispensing nozzle 210. According to alternative embodiments, additive supply conduit 222 may be connected further upstream on fluid supply conduit 202 or in a location where wash additive may dissolve more quickly, e.g., near hot water inlet 204.

In some exemplary embodiments as shown in FIG. 3, smart dispensing system 200 may include a valve 228 configured to control the flow of wash additive through additive supply conduit 222. For example, valve 228 may be a solenoid valve that is communicatively coupled with controller 108. Controller 108 may selectively open and close valve 228 to allow wash additive to flow from additive dispenser 220 through additive supply conduit 222. For example, during a rinse cycle where only water is desired, valve 228 may be closed to prevent wash additive from being dispensed through additive supply conduit 222. In some embodiments, valve 228 is selectively controlled based on at least one of the selected wash cycle, the soil level of the articles to be washed, and the article type.

In some exemplary embodiments, alternatively or in addition to valve 228, smart dispensing system 200 may include a dosing pump 230 configured to control the flow of wash additive through additive supply conduit 222. Dosing pump 230 may be an electrical pump, for example. Dosing pump 230 may be communicatively coupled with controller 108 and may be activated to flow wash additive into fluid supply conduit 202. Controller 108 may selectively activate dosing pump 230 to allow wash additive to flow from additive dispenser 220 through additive supply conduit 222. For example, during a rinse cycle where only water is desired, dosing pump 230 may be deactivated to prevent wash additive from being dispensed through additive supply conduit 222. In some embodiments, dosing pump 230 is selectively controlled based on at least one of the selected wash cycle, the soil level of the articles to be washed, the article type, and the viscosity of the wash additive.

As further illustrated in FIG. 3, additive supply conduit 222 is positioned downstream from inductive regulator 214. Moreover, additive supply conduit 222 is positioned in fluid communication with fluid supply conduit 202. During operations, pressure generated at inductive regulator 214, e.g., between inlet 216 and outlet 218, may selectively increase or decrease the fluid pressure (e.g., water pressure) from supply inlets 204, 206. For example, inductive regulator 214 may increase pressure within fluid supply conduit 202 downstream from inductive regulator 214, e.g., at outlet 218. Inductive regulator 214 may be activated to propel or add additional propulsive force to water flowing from inlet 216 and outlet 218. Additionally or alternatively, inductive regulator 214 may decrease pressure within fluid supply conduit 202 downstream from inductive regulator 214, e.g., at outlet 218. Inductive regulator 214 may be activated to restrict or generate a counter-acting force to water flowing from inlet 216 and outlet 218. Inductive regulator 214 may thus be configured to propel or restrict fluid supply conduit 202.

For this embodiment, as shown in FIG. 3, additive dispenser 220 motivates wash additive through a negative or vacuum pressure. In such embodiments, additive supply conduit 222 may define a siphon channel that draws in wash additive from additive dispenser 220 when water flows through fluid supply conduit 202. More particularly, as water is supplied through fluid supply conduit 202 into wash tub 121, the flowing water creates a negative pressure within additive supply conduit 222 (i.e., the flowing water creates a pressure in the additive supply conduit 222 that is less than the pressure within the fluid supply conduit 202). This negative pressure may draw in wash additive from additive dispenser 220, e.g., in proportion to the amount of water flowing through fluid supply conduit 202. Additive supply conduit 222 may be calibrated according to a desired amount of wash additive. For instance, the siphon channel of additive supply conduit 222 may be sized and shaped to provide a selected flow rate, e.g., volumetric flow rate, of the wash additive. The selected flow rate of the wash additive may be set according to a predetermined flow rate and/or pressure through the fluid supply conduit 202, e.g., a flow rate determined or generated by inductive regulator 214. During operation, the selected flow rate of the wash additive may be proportional to the predetermined flow rate of water through the fluid supply conduit 202.

Further, for this embodiment, additive supply conduit 222 is fluidly connected to fluid supply conduit 202 through a Venturi nozzle 224. Venturi nozzle 224 is positioned downstream of inductive regulator 214 and receives the siphon channel of additive supply conduit 222. The additive supply conduit 222 and Venturi nozzle 224 may be configured (e.g., sized and shaped) to ensure the desired amount of wash additive is supplied for a given water flow rate through fluid supply conduit 202. For example, by changing the diameter of the additive supply conduit 222 and the flow restriction of Venturi nozzle 224, the volumetric flow rate of wash additive may be adjusted.

During operation, smart dispensing system 200 adds a wash additive from additive dispenser 220 in proportion to the amount of water flowing through fluid supply conduit 202. More specifically, water may be provided from cold water inlet 206 and hot water inlet 204 to achieve the desired water flow rate and temperature. This flow rate and temperature may be controlled by controller 108, e.g., by adjusting one or more of the components of the smart dispensing system 200, including for example, water inlet valve 208 (including one or both of valves 205, 207), inductive regulator 214, valve 228, and/or dosing pump 230) or may be manually adjusted by the user. Water flows into the fluid supply conduit 202 past Venturi nozzle 224, creating a negative pressure in additive supply conduit 222. This negative pressure draws in wash additive from additive dispenser 220. The wash additive travels through additive supply conduit 222 and is injected into fluid supply conduit 202 by Venturi nozzle 224. The water traveling through fluid supply conduit 202 entrains, mixes, and dissolves the wash additive to create a wash fluid that is dispensed into wash tub 121. Notably, the concentration of wash additive in the wash fluid may be proportional to the amount of water delivered to wash tub 121.

In accordance with exemplary aspects of the present disclosure, smart dispensing system 200 is configured to dispense a predetermined volume of wash additive based at least in part on the viscosity of the wash additive to be loaded or loaded into washing machine appliance 100. In this way, the proper volume of wash additive may be dispensed such that resultant wash fluid is optimal for wash performance and efficient use of the wash additives can be achieved.

Figure 4:
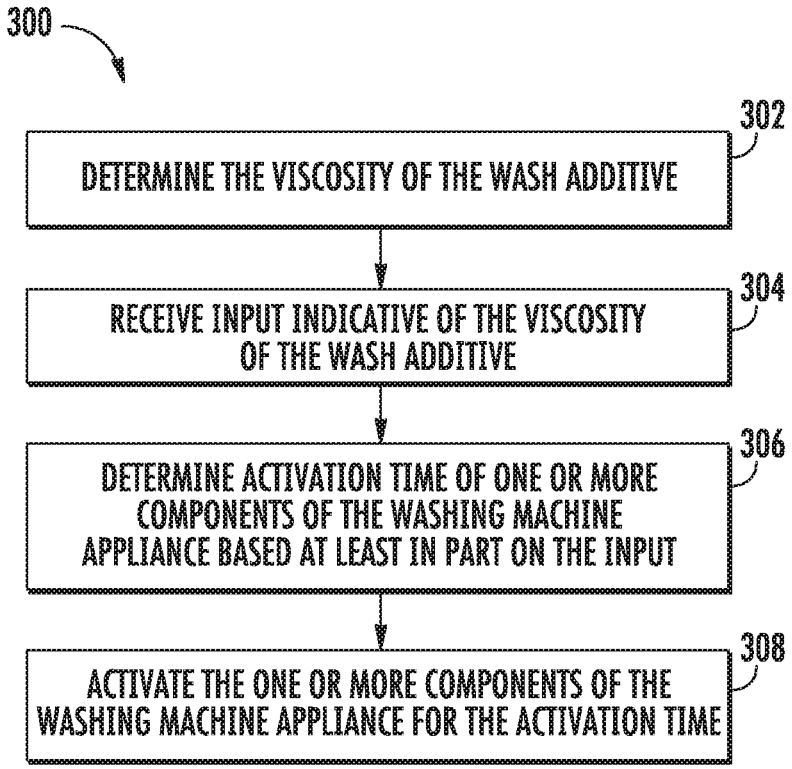
FIG. 4 provides a flow diagram of an exemplary method for operating a washing machine appliance with smart dispense capability according to an exemplary embodiment of the present disclosure.

FIG. 4 provides a flow diagram of an exemplary method (300) for operating a washing machine appliance with smart dispense capability according to an exemplary embodiment of the present disclosure. For instance, method (300) may be utilized to operate washing machine appliance 100 having smart dispensing system 200 of FIGS. 1 through 3. Reference numerals used to denote the various components of washing machine appliance 100 and smart dispensing system 200 of FIGS. 1 through 3 will be utilized below to provide context to method (300).

At (302), the method (300) includes determining the viscosity of the wash additive. The viscosity of the wash additive loaded or to be loaded within the washing machine appliance 100 may be determined in various exemplary ways. For instance, a user may directly enter or select the viscosity of the one or more wash additives to be loaded or loaded in washing machine appliance 100 or a user may present information to the washing machine appliance 100 or other application so that the washing machine appliance 100 or other application can determine the viscosity based on the presented information.

Figure 5:
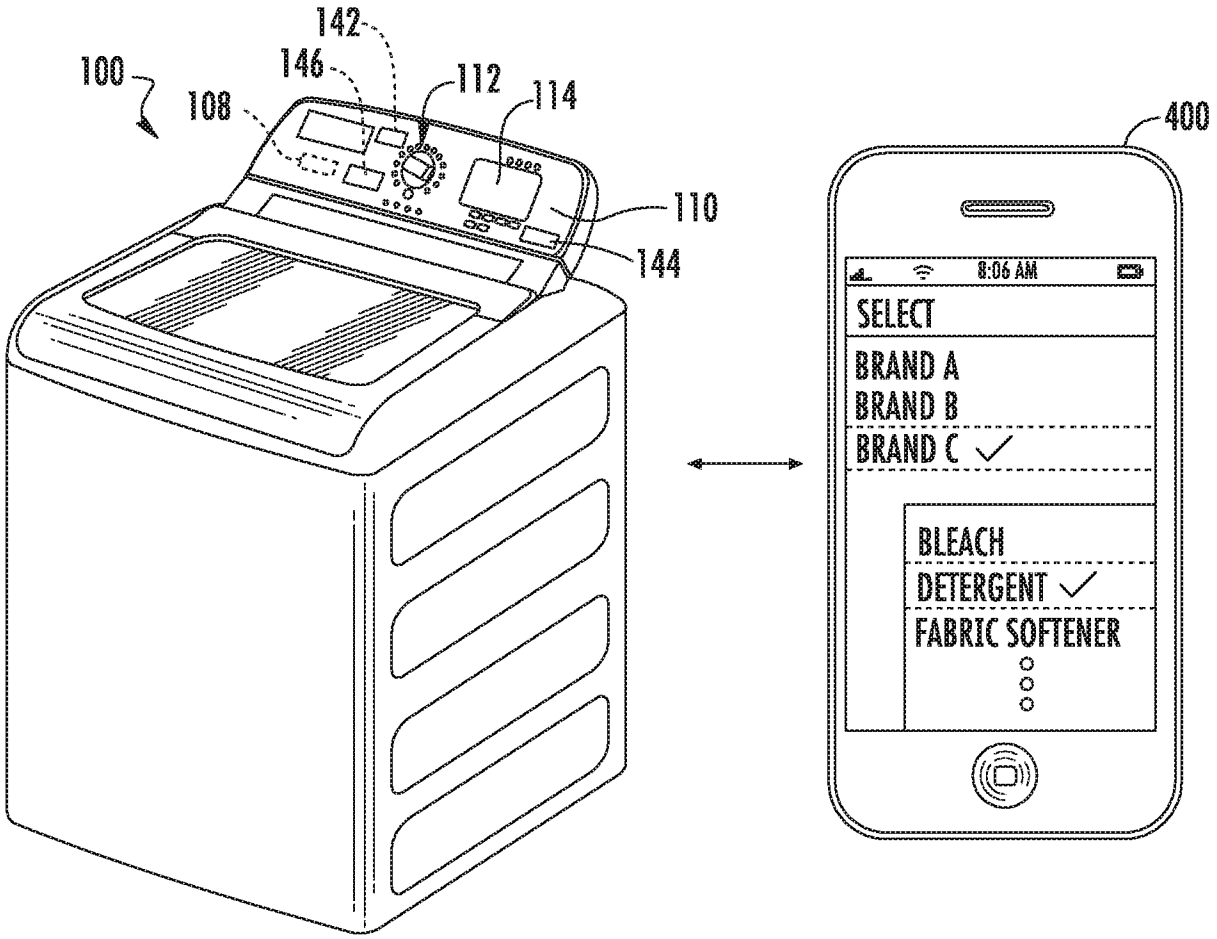
FIG. 5 provides a schematic view of various ways in which a viscosity of one or more wash additives loaded or to be loaded into a washing machine appliance may be determined according to various exemplary embodiments of the present disclosure.

FIG. 5 provides a schematic view of various ways in which the viscosity of one or more wash additives loaded or to be loaded into washing machine appliance 100 may be determined. As one example, a user may directly enter or select the viscosity of a wash additive by interfacing with input selectors 112 and/or display 114 of control panel 110 of washing machine appliance 100. For instance, a user may utilize input selectors 112 to enter four hundred centistokes (400 cSt) as the viscosity of one of the wash additives contained within additive dispenser 220 of smart dispensing system 200. As another example, a user may provide a voice command to a microphone 142 of washing machine appliance 100. As yet another example, a user may directly enter or select the viscosity of a wash additive to be loaded or loaded in washing machine appliance 100 by interfacing with an application or webpage of a user device 400 that is communicatively coupled (e.g., by a wireless or wired connection) with the washing machine appliance 100. For instance, a user may enter the viscosity, select the viscosity from a menu, or may provide a voice command to user device 400. User device 400 may then rout the viscosity to washing machine appliance 100.

As noted above, the viscosity of the one or more wash additives loaded or to be loaded within washing machine appliance 100 may be determined by washing machine appliance 100 or user device 400. For instance, a user may present information to washing machine appliance 100 or user device 400 so that washing machine appliance 100 or user device 400 may determine the viscosity based on the presented information.

As one example, with reference still to FIG. 5, a user may present information to washing machine appliance 100, and more particularly to microphone 142 of washing machine appliance 100, via a voice command. For instance, a user may audibly present the brand type and wash additive type of the wash additive to be loaded or loaded in washing machine appliance 100. For example, a user may audibly present the brand and additive type as follows: "the brand type is 'Brand A' and the wash additive type is 'detergent.'" As yet another example, a user may select the brand type and wash additive type using one or more input selectors 112 and/or display 114 of control panel 110 of washing machine appliance 100. By presenting the brand and wash additive type to washing machine appliance 100, controller 108 of washing machine appliance 100 can determine the viscosity. For instance, controller 108 may include a library of information stored in one or more of its memory devices that contains data listing various brand and wash additive types and their corresponding viscosities. Accordingly, when a user presents the brand type and wash additive type of the wash, controller 108 can look up the viscosity or viscosities of the one or more wash additives.

As yet another example, in some exemplary embodiments, washing machine appliance 100 includes a scanning device 144 as shown in FIG. 5. Scanning device 144 may be used to scan a visual code (e.g., Quick Response (QR) code, Universal Product Code (UPC), other types of bar codes, etc.) of a container in which the wash additive is stowed. Thus, a user may present the container proximate scanning device 144 so that scanning device 144 may read the visual code. Based on the visual code, controller 108 can determine the viscosity of the wash additive, e.g., by using a lookup table.

As a further example, in some embodiments, washing machine appliance 100 includes an image capture device 146, such as a camera, that is configured to capture an image of the container in which the wash additive loaded or to be loaded within washing machine appliance 100 is stowed. Thus, a user may present the container proximate image capture device 146 so that image capture device 146 may capture the image of the container. Based on the captured image of the container, controller 108 can determine the viscosity of the wash additive, e.g., by using image recognition module or software. Additionally or alternatively, image capture device 146 may capture the image of the wash additive itself. Based on the captured image of the wash additive, controller 108 can determine the viscosity of the wash additive, e.g., by using image recognition module or software.

In some instances, the viscosity of the one or more wash additives loaded or to be loaded within washing machine appliance 100 may be determined by user device 400, e.g., by a user presenting information to user device 400 communicatively coupled with washing machine appliance 100.

As one example, a user may present brand type and wash additive type information to a microphone of user device 400 via a voice command. An application or webpage running on user device 400 may collect the voice information and thereafter, the selected brand and wash additive types may be routed to controller 108 of washing machine appliance 100 so that controller 108 may determine the viscosity of the wash additive, e.g., in a manner as noted above. Alternatively, the brand and wash additive types may be determined by the controller of user device 400 by looking up the viscosity in a cloud-based library that corresponds a particular brand and wash additive type with a viscosity. After the controller of user device 400 determines the viscosity, user device 400 may route the determined viscosity to washing machine appliance 100, e.g., so that the proper volume of wash additive can be dispensed.

As another example, a user may present the brand and wash additive type by selecting or entering them on an application or webpage of user device 400, e.g., utilizing one or more input selectors and/or touch displays of user device 400. As shown in FIG. 5, a user is presenting the brand and wash additive type of a wash additive. In particular, the user is shown presenting the brand and wash additive type of a wash additive by selecting the brand and wash additive type of a wash additive on the application running on user device 400, which in this embodiment is a smart phone. As depicted, the user has selected "Brand C" as the brand type and "Detergent" as the wash additive type. Once entered or selected, the brand and wash additive type may be routed to controller 108 of washing machine appliance 100 so that controller 108 may determine the viscosity of the wash additive. Alternatively, the viscosity of the wash additive may be determined by the controller of user device 400 by looking up the viscosity in a cloud-based library that corresponds a particular brand and wash additive type with a viscosity, as noted above. After the controller of user device 400 determines the viscosity, user device 400 may route the determined viscosity to washing machine appliance 100.

As yet another example, a user may present the visual code of a container in which the wash additive is stowed (or other packaging) and a scanning device of the user device 400 may scan and capture the visual code. Thereafter, the visual code can be sent to controller 108 of washing machine appliance 100 for a determination of the viscosity of the wash additive, or alternatively, the viscosity may be determined by the controller of user device 400 by looking up the viscosity that corresponds with the visual code in a cloud-based library. After the controller of user device 400 determines the viscosity, user device 400 may route the determined viscosity to washing machine appliance 100. As a further example, a user may capture the image of a container in which the wash additive is stowed (or other packaging) and/or the wash additive itself with an image capture device of user device 400. Thereafter, the captured image can be sent to an image database or module of controller 108 of washing machine appliance 100 for a determination of the viscosity of the wash additive. Alternatively, the viscosity may be determined by the controller of user device 400 by comparing the captured image of the container and/or wash additive to images in a cloud-based library of images. After the controller of user device 400 determines the viscosity, user device 400 may route the determined viscosity to washing machine appliance 100.

In some instances, the wash additive that the user intends to use with washing machine appliance 100 is not a recognized brand or type or the actual viscosity of the wash additive is unknown. For instance, a user may wish to formulate a homemade wash additive. In such instances, the viscosity may be determined in the exemplary manner noted below.

Figure 6:
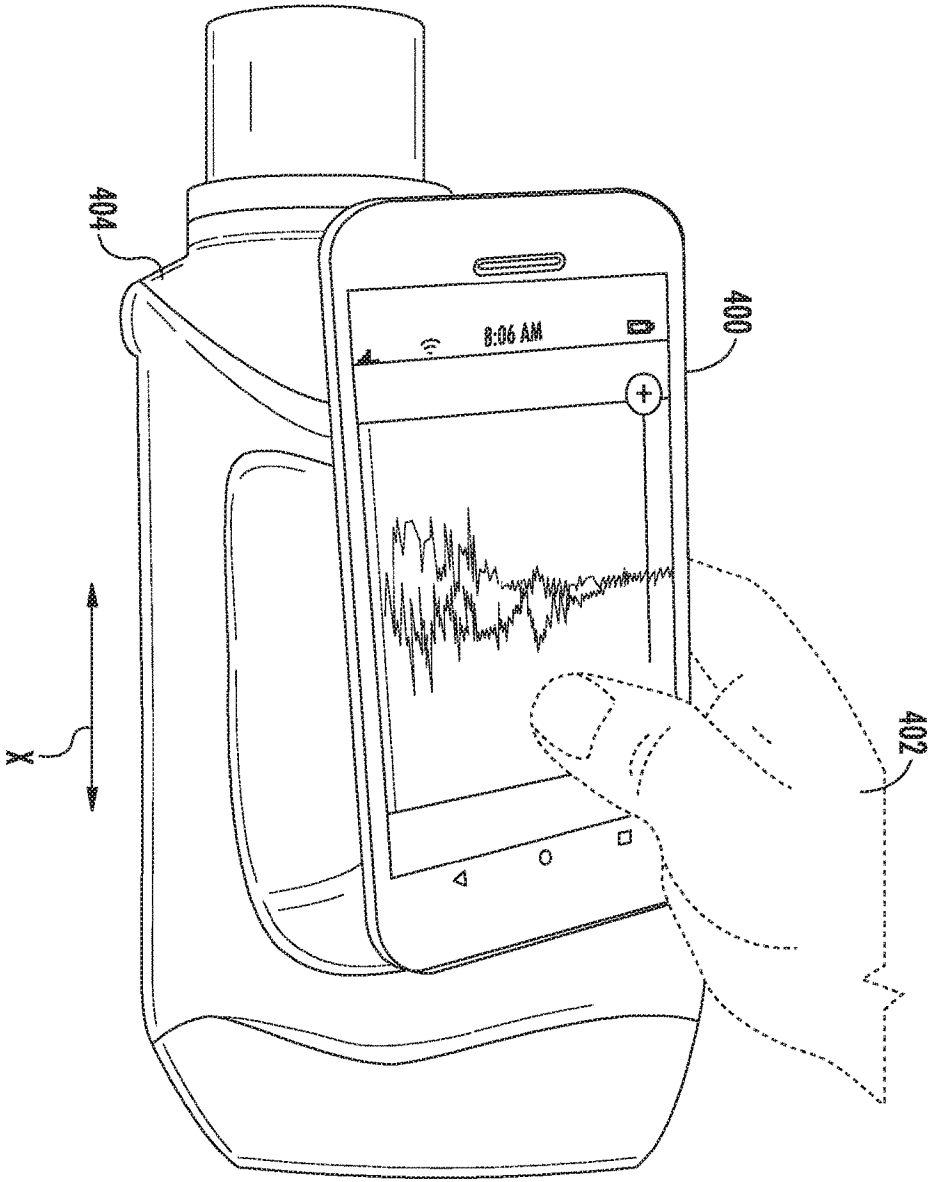
FIG. 6 provides one method of determining the viscosity of a wash additive to be loaded or loaded in a washing machine appliance according to an exemplary embodiment of the present disclosure.

FIG. 6 provides one method of determining the viscosity of a wash additive to be loaded or loaded in washing machine appliance 100 according to an exemplary embodiment of the present disclosure. As shown in FIG. 6, a user 402 is holding user device 400 and a container 404 proximate one another. In particular, for this embodiment, user device 400 is held in contact with container 404. User device 400 includes an accelerometer or other suitable sensor for detecting an acceleration profile of the wash additive within the container 404.

To determine the viscosity of wash additive within container 404, container 404 in which the wash additive is stowed and user device 400 are jolted together in unison in a given direction. Preferably, container 404 and user device 400 are jolted along a single translational axis X, e.g., along the vertical, lateral or transverse direction V, L, T. Container 404 and user device 400 may be jolted in a single movement forward or backward along the translational axis X or may be shaken together back and forth along the translational axis X for a period of time. As the container 404 and user device 400 are accelerated along the translational axis X, the accelerometer or other sensing device of user device 400 records an acceleration profile of the wash additive within container 404. Based on the acceleration profile, the viscosity of the wash additive may be estimated.

Figure 7:
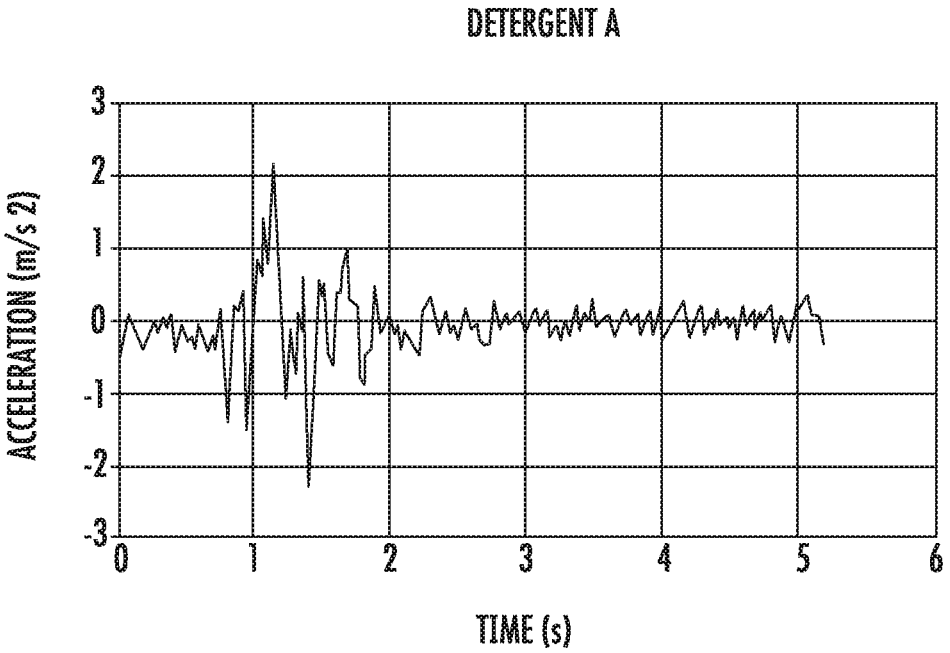
FIG. 7 provides an exemplary acceleration profile of one exemplary wash additive according to an exemplary embodiment of the present disclosure.
Figure 8:
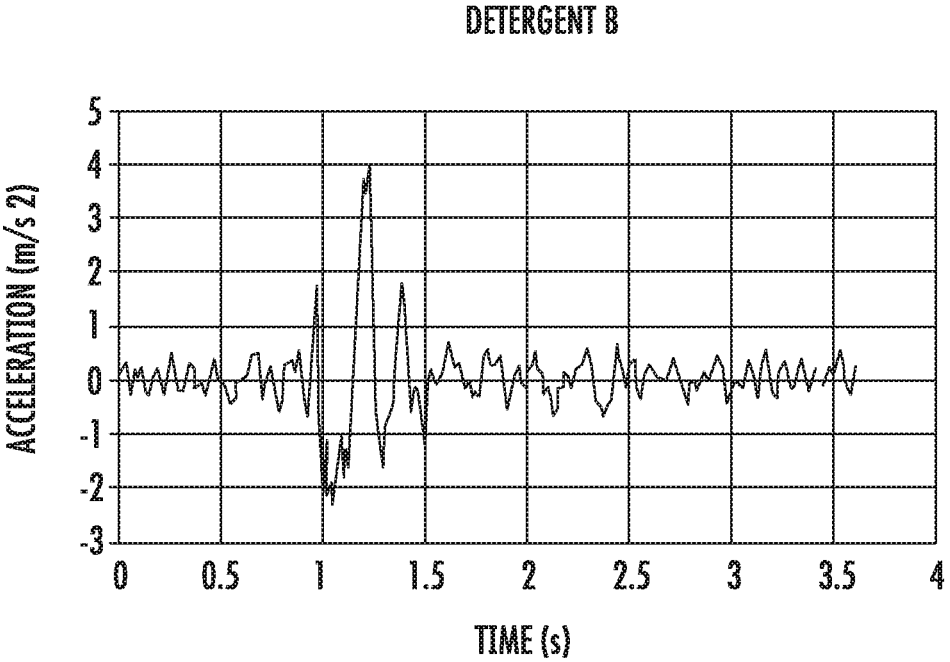
FIG. 8 provides another exemplary acceleration profile of a wash additive according to an exemplary embodiment of the present disclosure.

FIGS. 7 and 8 provide example acceleration profiles of two different wash additives that underwent jolting as described above. In particular, FIG. 7 depicts the acceleration profile of Detergent A and FIG. 8 provides the acceleration profile of Detergent B. For both examples, the container 404 was filled half way with detergent during jolting. The acceleration profiles can be generated by user device 400 and then routed to controller 108 of washing machine appliance 100 for determining the viscosity based on the acceleration profile, or alternatively, an application on user device 400 may determine the viscosity of the wash additive based on the acceleration profile of the wash additive within container 404.

For the acceleration profile of FIG. 7, container 404 and user device 400 were held in place for a predetermined time so that the accelerometer could generate a steady-state baseline of the average amplitude of the acceleration of the wash additive within container 404 while at rest. For Detergent A, the steady-state baseline had an amplitude of about 0.2 $m/s^2$. As shown in FIG. 7, at about 0.8 seconds, container 404 and user device 400 were jolted along the translational axis X. To determine the viscosity of detergent A, the "slosh time" or time required for the average amplitude of the acceleration to obtain a value within a predetermined percentage of the steady-state baseline for a predetermined time is calculated. That is, the amount of time required for Detergent A to reach a predetermined percentage of its steady-state baseline for a predetermined time is calculated. For instance, in this embodiment, the predetermined percentage was thirty percent (30%) and the predetermined time was 0.2 seconds. It will be appreciated that the noted predetermined variables are exemplary. Once the slosh time was calculated, the slosh time was utilized to look up a viscosity that corresponds to the calculated slosh time. The lookup table may be stored in a memory device of controller 108 of washing machine appliance 100 or may be stored in a cloud-based server linked to an application on user device 400. For this embodiment, the amplitude of the acceleration of Detergent A returned to steady-state at about 2.2 seconds. Thus, the slosh time was about one and four tenths seconds (1.4 s). Based on the acceleration profile, and more particularly on the slosh time, the viscosity of the Detergent A was determined to be about two hundred centistokes (200 cSt).

For the acceleration profile of FIG. 8, container 404 and user device 400 were held in place for a predetermined time so that the accelerometer could generate a steady-state baseline of the average amplitude of the acceleration of the wash additive within container 404 while at rest. For Detergent B, the steady-state baseline had an amplitude of about 0.3 $m/s^2$. At about 0.9 seconds, container 404 and user device 400 were jolted along the translational axis X. This point in time (i.e., 0.9 seconds) is recognized as the start of the slosh period as the average amplitude of the acceleration exceeded the steady-state baseline amplitude by more than a predetermined percentage, such as e.g., thirty percent (30%). For the wash additive of FIG. 8, the amplitude of the acceleration of Detergent B returned to steady-state at about 1.5 seconds. Thus, the slosh time for Detergent B was about a half second (0.5 s). Based on the acceleration profile, and more particularly on the slosh time, the viscosity of Detergent B was determined to be about one thousand centistokes (1,000 cSt).

Thus, in some implementations, to determine the viscosity of a wash additive, the method (300) includes jolting a container in which the wash additive is stowed together with a user device. The user device has an accelerometer or other sensing device capable of measuring the fluid characteristics of the wash additive within the container. After or during jolting, in this implementation, the method (300) includes recording an acceleration profile of the wash additive within the container and determining a slosh time of the wash additive based at least in part on the acceleration profile of the wash additive. A processing unit of the user device may determine the slosh time or controller 108 of washing machine appliance may determine the slosh time. Thereafter, in this implementation, the method (300) includes determining the viscosity of the wash additive based at least in part on the slosh time of the wash additive.

In some further exemplary implementations of method (300), in addition to or alternatively to utilizing the slosh time to determine the viscosity of the wash additive, the number of rebounds (i.e., the number of peaks and valleys) of the acceleration of the wash additive within container 404 during the slosh time may be used to provide further input and insight into the viscosity of the wash additive within container 404.

At (304), with reference again to FIG. 4, the method (300) includes receiving an input that is indicative of a viscosity of the wash additive. For instance, controller 108 of washing machine appliance 100 may receive the input indicative of the viscosity of a wash additive to be loaded or loaded within additive dispenser 220 of washing machine appliance 100. In this way, the proper volume of wash additive to be dispensed may be determined.

In some instances, the input indicative of the viscosity of the wash additive may be the actual viscosity of the wash additive, e.g., the input might be five hundred centistokes (500 cST), in which case the viscosity is determined prior to the input being received at (304). In other instances, the input indicative of the viscosity of the wash additive may be information indicative of the viscosity but not the actual viscosity value of the wash additive, in which case the viscosity is determined after the input is received at (304). For example, as noted above, the input may include the brand type and wash additive type of the wash additive loaded or to be loaded in the additive dispenser 220 of washing machine appliance 100, and based on these inputs, the viscosity of the wash additive may be determined.

At (306), the method (300) includes determining an activation time of one or more components of a dispensing system of the washing machine appliance based at least in part on the input such that a predetermined volume of wash additive is dispensed.

As one example, the one or more components of the dispensing system 200 include water inlet valve 208 of washing machine appliance 100. In this example, the activation time corresponds with a time in which the water inlet valve 208 is positioned in an open position. In the open position, as will be appreciated, water is allowed to flow through water inlet valve 208 and downstream through fluid supply conduit 202 and ultimately into wash tub 121 (see FIG. 3). By controlling the valve open time (i.e., its activation time), the volume of water flowing through fluid supply conduit 202 is controlled. The modulation of hot water valve 205 and cold water valve 207 of water inlet valve 208 may be controlled by controller 108, for example. As flowing water through fluid supply conduit 202 creates a negative pressure within additive supply conduit 222 (caused by the Venturi nozzle 224 positioned upstream of and proximate to where the additive supply conduit 222 fluidly connects with fluid supply conduit 202), the negative pressure draws wash additive from additive dispenser 220 to fluid supply conduit 202, e.g., in proportion to the amount of water flowing through fluid supply conduit 202. Thus, by controlling the flow through fluid supply conduit 202, the volume of wash additive dispensed from additive dispenser is likewise controlled. Accordingly, for this embodiment, the activation time of the water inlet valve 208 directly corresponds to the volume of wash additive dispensed from additive dispenser 220.

As such, utilizing the determined viscosity of the wash additive, the activation time to achieve the desired flow of water through fluid supply conduit 202 such that an optimal amount of wash additive is dispensed may be determined, e.g., by using a lookup table that correlates viscosities of wash additives with an activation time of the water valve 208. For a wash additive having a relatively high viscosity, the activation time of water inlet valve 208 may be greater than the activation time for a wash additive having a relatively low viscosity, as it will take more time for the high viscosity wash additive to be pulled or drawn out of additive dispenser 220 and into fluid supply conduit 202.

As another example, the one or more components of the dispensing system 200 include dosing pump 230 of washing machine appliance 100. In this example, the activation time corresponds with a time in which dosing pump 230 is pumping wash additive from additive dispenser 220 into fluid supply conduit 202 and ultimately into wash tub 121. By controlling the "on time" or activation time of dosing pump 230, the volume of wash additive dispensed into fluid supply conduit 202 and ultimately wash tub 121 may be controlled. In this way, the optimal amount of wash additive may be mixed with water to form a wash fluid that is optimal for wash performance, e.g., by using a lookup table that correlates viscosities of wash additives with an activation time of dosing pump 230. The activation time of dosing pump 230 may be greater for wash additives having a relatively high viscosity than wash additives having a relatively low viscosity, as more work is required to move a relatively high viscosity wash additive then a relatively low viscosity wash additive.

As yet another example, the one or more components of the dispensing system 200 include inductive regulator 214 of washing machine appliance 100. In this example, the activation time corresponds with a time in which inductive regulator 214 is regulating the volumetric flow through fluid supply conduit 202. That is, inductive regulator 214 may regulate wash fluid or water through fluid supply conduit 202 by propelling or restricting the water therethrough. The time in which inductive regulator 214 either propels or restricts the fluid through fluid supply conduit 202 may be deemed the activation time. For relatively high viscosity wash additives, inductive regulator 214 may propel fluid through fluid supply conduit 202 so as to increase the rate that wash additive is pulled or drawn from additive dispenser 220. In contrast, for relatively low viscosity wash additives, inductive regulator 214 may restrict fluid through fluid supply conduit 202 so as to decrease the rate that wash additive is pulled or drawn from additive dispenser 220. By controlling the "on time" or activation time of inductive regulator 214, the volume of water flowing through fluid supply conduit 202 is controlled. As noted above, as flowing water through fluid supply conduit 202 creates a negative pressure within additive supply conduit 222 (caused by the Venturi nozzle 224), the negative pressure draws wash additive from additive dispenser 220 to fluid supply conduit 202, e.g., in proportion to the amount of water flowing through fluid supply conduit 202. Thus, by controlling the flow through fluid supply conduit 202, the volume of wash additive dispensed from additive dispenser is controlled. Accordingly, for this embodiment, the activation time of inductive regulator 214 directly corresponds to the volume of wash additive dispensed from additive dispenser 220. As such, the optimal amount of wash additive may be mixed with water to form a wash fluid that is optimal for wash performance, e.g., by using a lookup table that correlates viscosities of wash additives with an activation time of inductive regulator 214. Although water inlet valve 208, dosing pump 230, and inductive regulator 214 were provided as examples of components of dispensing system 200 that may have their activation times altered or modified based on the viscosity of the wash additive in additive dispenser 220, it will be appreciated that other components of dispensing system 200 may have their activation times altered or modified based at least in part on the viscosity of the wash additive, such as e.g., valve 228 (FIG. 3).

In some implementations of method (300), in addition to receiving an input indicative of the viscosity of the wash additive to be loaded or loaded in additive dispenser 220 of washing machine 100, the method (300) further includes receiving an input that is indicative of a stain status of articles within the wash chamber of wash tub 121. For example, if one or more of the articles within wash chamber have one or more stains that the user would like to address, e.g., with additional wash additive, a user may input a stain status of the articles. For example, a user may input the stain status by selecting or entering the stain status of the articles through an application or webpage on a user device 400 or by selecting or entering the stain status by directly interfacing with washing machine appliance 100. The input indicative of the stain status may be used in addition to the viscosity input to determine the activation time of the one or more components of smart dispensing system 200. This offers a user additional flexibility and may provide improved wash performance of the stained articles.

In some implementations, the method (300) further includes receiving an input that is indicative of a water quality of water flowing into water inlet valve 208 of dispensing system 200, or more broadly, the water flowing through dispensing system 200. For example, if a user knows whether the water flowing into water inlet valve 208 is hard or soft, well or city water, whether a water softener is upstream of water inlet valve 208, etc., a user may input such a water quality status through an application or webpage on a user device 400 or by selecting or entering the water quality status by directly interfacing with washing machine appliance 100. The input indicative of the water quality may be used in addition to the viscosity input to determine the activation time of the one or more components of smart dispensing system 200. This offers a user additional smart capability to smart dispensing system 200 and may improve wash performance of articles.

In some implementations, the method (300) further includes receiving an input that is indicative of a load size of the articles within the washing chamber of wash tub 121. For example, a user may input the load size as one of a large, medium, or small load. A user may input the load size through an application or webpage on a user device 400 or by selecting or entering the load size by directly interfacing with washing machine appliance 100, e.g., by using input selectors 112. The input indicative of the load size may be used in addition to the viscosity input to determine the activation time of the one or more components of smart dispensing system 200. This may provide additional smart capability to smart dispensing system 200 and may improve wash performance of articles.

In some further implementations, the method (300) further includes receiving an input that is indicative of a load type of the articles within the washing chamber of wash tub 121. For example, a user may input the load types as a heavy fabric, delicate fabric, etc. A user may input the load type through an application or webpage on a user device 400 or by selecting or entering the load size by directly interfacing with washing machine appliance 100, e.g., by using input selectors 112. The input indicative of the load type may be used in addition to the viscosity input to determine the activation time of the one or more components of smart dispensing system 200. This may provide additional smart capability to smart dispensing system 200 and may improve wash performance of articles.

In yet further implementations, the method (300) further includes receiving an input that is indicative of a temperature setting of the wash fluid to be dispensed into the washing chamber of wash tub 121. For example, a user may input the temperature setting as hot, cold, or medium. A user may input the temperature sensor through an application or webpage on a user device 400 or by selecting or entering the load size by directly interfacing with washing machine appliance 100, e.g., by using input selectors 112. The input indicative of the temperature setting of the wash fluid may be used in addition to the viscosity input to determine the activation time of the one or more components of smart dispensing system 200. This may provide additional smart capability to smart dispensing system 200 and may improve wash performance of articles.

At (308), the method (300) includes activating the one or more components based at least in part on the activation time. As one example, the one or more components of dispensing system 200 include water inlet valve 208. To activate water inlet valve 208 based at least in part on the activation time, activating water inlet valve 208 includes opening water inlet valve 208 for the activation time. As another example, the one or more components of dispensing system 200 include dosing pump 230. To activate dosing pump 230 based at least in part on the activation time, activating dosing pump 230 includes pumping the predetermined volume of the wash additive with the dosing pump for the activation time. As yet another example, the one or more components of dispensing system 200 include inductive regulator 214. To activate inductive regulator 214 based at least in part on the activation time, activating inductive regulator 214 includes propelling or restricting the flow of water through fluid supply conduit 202 for the activation time. By activating the one or more components for the activation time, the proper volume of wash additive may be dispensed from additive dispenser 220. In this way, the wash additive may be mixed with water to form a wash fluid that is optimal for wash performance.

In some implementations, multiple components of the dispensing system 200 may be activated. For instance, water inlet valve 208 may be activated for an activation time and inductive regulator 214 may be regulated for an activation time. The activation times may be the same or different times. Further the times may be offset from one another. That is, the activation time of one component may start or stop at a different time than another component of dispensing system 200.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:

a cabinet;

a tub positioned within the cabinet;

a wash basket rotatably mounted within the tub, the wash basket defining a wash chamber for receiving articles for washing;

a dispensing system comprising one or more components for delivering a wash fluid to the wash chamber, the dispensing system comprising an additive dispenser for containing a wash additive configured to be mixed with the wash fluid; and a controller communicatively coupled with the one or more components of the dispensing system, the controller configured to:

receive an input indicative of a viscosity of the wash additive contained within the additive dispenser, wherein the input is an acceleration profile recorded by a user device in response to a container containing the wash additive and the user device jolted together in unison;

determine the viscosity of the wash additive based at least in part on the recorded acceleration profile;

determine an activation time for the one or more components of the dispensing system based at least in part on the determined viscosity of the wash additive; and activate the one or more components for the activation time such that a predetermined volume of the wash additive is dispensed into the wash chamber.

2. The washing machine appliance of claim 1, wherein the one or more components of the dispensing system comprise:

a water inlet valve, wherein when the controller activates the one or more components, the water inlet valve is activated such that the predetermined volume of the wash additive is dispensed into the wash chamber.

3. The washing machine appliance of claim 2, wherein when the water inlet valve is activated, the water inlet valve is modulated to an open position for the activation time.

4. The washing machine appliance of claim 1, wherein the one or more components of the dispensing system comprise:

a dosing pump, wherein when the controller activates the one or more components, the dosing pump is activated such that the predetermined volume of the wash additive is dispensed into the wash chamber.

5. The washing machine appliance of claim 1, wherein the one or more components of the dispensing system comprise:

a water inlet valve positioned upstream of the additive dispenser;

a fluid supply conduit providing fluid communication between the water inlet valve and the wash chamber;

an additive supply conduit providing fluid communication between the additive dispenser and the fluid supply conduit; and a Venturi nozzle positioned upstream of a location where the additive supply conduit fluidly connects with the fluid supply conduit.

6. The washing machine appliance of claim 5, wherein the one or more components of the dispensing system comprise:

a valve positioned along the additive supply conduit, wherein when the controller activates the one or more components, the valve is activated such that the predetermined volume of the wash additive is dispensed into the wash chamber.

7. The washing machine appliance of claim 1, wherein the input indicative of the viscosity of the wash additive contained within the additive dispenser includes a brand type and a wash additive type of the wash additive.

8. The washing machine appliance of claim 1, wherein the controller is further configured to:

receive an input indicative of a load size of articles within the wash chamber, wherein the activation time for the one or more components of the dispensing system is determined based at least in part on the input of the load size.

9. The washing machine appliance of claim 1, wherein the controller is further configured to:

receive an input indicative of temperature setting of the wash fluid, and wherein the activation time for the one or more components of the dispensing system is determined based at least in part on the temperature setting.

10. The washing machine appliance of claim 1, wherein in determining the viscosity of the wash additive based at least in part on the acceleration profile, the controller is configured to:

determine a slosh time of the wash additive based at least in part on the recorded acceleration profile of the wash additive, and wherein the viscosity of the wash additive is determined based at least in part on the determined slosh time.

11. The washing machine appliance of claim 10, wherein the slosh time is a time required, after the container containing the wash additive is jolted in unison with the user device, for an average amplitude of an acceleration of the wash fluid within the container to obtain a value within a predetermined percentage of a steady-state baseline for a predetermined time.

12. The washing machine appliance of claim 10, wherein in determining the viscosity of the wash additive based at least in part on the determined slosh time, the controller is configured to:

look up, in a lookup table stored in a memory device of the controller, a viscosity that corresponds to the determined slosh time, and wherein the viscosity that corresponds to the determined slosh time is determined as the viscosity of the wash additive.

13. The washing machine appliance of claim 10, wherein in determining the viscosity of the wash additive based at least in part on the acceleration profile, the controller is configured to:

determine a number of rebounds of an acceleration of the wash additive within the container during the slosh time, and wherein the viscosity of the wash additive is determined based at least in part on the determined number of rebounds.

14. The washing machine appliance of claim 1, wherein the controller is further configured to:

receive an input indicative of a water quality of water flowing into a water inlet valve of the dispensing system, and wherein the activation time for the one or more components of the dispensing system is determined based at least in part on the water quality of water flowing into the water inlet valve of the dispensing system.

15. A washing machine appliance, comprising:

a cabinet;

a tub positioned within the cabinet;

a wash basket rotatably mounted within the tub, the wash basket defining a wash chamber for receiving articles for washing;

a dispensing system comprising one or more components for delivering a wash fluid to the wash chamber, the dispensing system comprising an additive dispenser for containing a wash additive configured to be mixed with the wash fluid;

a scanning device; and a controller communicatively coupled with the one or more components of the dispensing system and the scanning device, the controller configured to:

receive an input indicative of a viscosity of the wash additive contained within the additive dispenser, wherein the input is an acceleration profile recorded by a user device in response to a container containing the wash additive and the user device jolted together in unison;

determine the viscosity of the wash additive based at least in part on the recorded acceleration profile, wherein in determining the viscosity of the wash additive based at least in part on the acceleration profile, the controller is configured to: determine a slosh time of the wash additive based at least in part on the recorded acceleration profile of the wash additive, and wherein the viscosity of the wash additive is determined based at least in part on the determined slosh time;

determine an activation time for the one or more components of the dispensing system based at least in part on the determined viscosity of the wash additive; and activate the one or more components for the activation time such that a predetermined volume of the wash additive is dispensed into the wash chamber.

16. A washing machine appliance, comprising:

a cabinet;

a tub positioned within the cabinet;

a wash basket rotatably mounted within the tub, the wash basket defining a wash chamber for receiving articles for washing;

a dispensing system comprising one or more components for delivering a wash fluid to the wash chamber, the dispensing system comprising an additive dispenser for containing a wash additive configured to be mixed with the wash fluid; and a controller communicatively coupled with the one or more components of the dispensing system and the image capture device, the controller configured to:

receive an input indicative of a viscosity of the wash additive contained within the additive dispenser, wherein the input is an acceleration profile recorded by a user device in response to a container containing the wash additive and the user device jolted together in unison;

determine the viscosity of the wash additive based at least in part on the recorded acceleration profile, wherein in determining the viscosity of the wash additive based at least in part on the acceleration profile, the controller is configured to: determine a slosh time of the wash additive based at least in part on the recorded acceleration profile of the wash additive; determine a number of rebounds of an acceleration of the wash additive within the container during the slosh time, and wherein the viscosity of the wash additive is determined based at least in part on the determined number of rebounds;

determine an activation time for the one or more components of the dispensing system based at least in part on the determined viscosity of the wash additive; and activate the one or more components for the activation time such that a predetermined volume of the wash additive is dispensed into the wash chamber.

* * * * *